United States Patent [19]
Ashley et al.
[11] 4,166,407
[45] Sep. 4, 1979

[54] DRIVE MECHANISM FOR A GATLING GUN

[75] Inventors: Eugene Ashley; Thomas W. Cozzy, both of Burlington, Vt.

[73] Assignee: General Electric Company, Burlington, Vt.

[21] Appl. No.: 867,248

[22] Filed: Jan. 5, 1978

[51] Int. Cl.² ..... F41D 7/04
[52] U.S. Cl. ..... 89/12; 89/160
[58] Field of Search ..... 89/7, 12, 160

[56] References Cited

U.S. PATENT DOCUMENTS

| | | | |
|---|---|---|---|
| 2,756,639 | 7/1956 | Bird | 89/126 |
| 2,965,003 | 12/1960 | McThomas | 89/126 |
| 2,989,900 | 6/1961 | Grover | 89/12 |
| 3,017,807 | 1/1962 | Grover | 89/12 |
| 3,041,939 | 7/1962 | Dardick | 89/126 |
| 3,071,043 | 1/1963 | McThomas | 89/12 |
| 3,311,022 | 3/1967 | Bernard et al. | 89/126 |
| 3,407,701 | 10/1968 | Chiabrandy | 89/126 |
| 3,568,563 | 3/1971 | Folsom | 89/126 |
| 3,800,657 | 4/1974 | Broxholm et al. | 89/7 |
| 3,834,271 | 9/1974 | Patenaude et al. | 89/12 |

*Primary Examiner*—Stephen C. Bentley
*Attorney, Agent, or Firm*—Bailin L. Kuch

[57] ABSTRACT

A Gatling gun wherein a fluid under pressure drives a plurality of double acting pistons to respectively reciprocate each of the gun bolts in the rotor. The gun bolts have respective cam followers which operate in a stationary helical cam to cause rotation of the rotor.

8 Claims, 8 Drawing Figures

FRONT PORT

REAR PORT

FRONT PORT

REAR PORT

DRIVE MECHANISM FOR A GATLING GUN

BACKGROUND OF THE INVENTION

1. Field of the Invention

This invention relates to means for driving a gun in which the barrels revolve during the loading operation, e.g. a Gatling gun.

2. Prior Art

In conventional Gatling guns, the power source, of whatever kind, has been coupled to the barrel cluster or rotor, to cause the rotor to rotate, which in turn, has driven the gun bolts, usually through a helical cam in the outer housing driving cam followers on the bolts. A torsion shaft drive of the rotor is shown in U.S. Pat. No. 2,989,900 issued June 27, 1961 to D. P. Grover. A recoiling barrel drive of the rotor is shown in U.S. Pat. No. 2,965,003 issued Dec. 20, 1960 and U.S. Pat. No. 3,071,043 issued Jan. 1, 1963, both to W. D. McThomas. Various gun-gas drives of the rotor are shown in U.S. Pat. No. 2,756,639 issued July 31, 1956 to J. R. Bird; U.S. Pat. No. 3,017,807 issued Jan. 23, 1962 to D. P. Grover; U.S. Pat. No. 3,041,939 issued July 3, 1962 to D. Dardick; U.S. Pat. No. 3,311,022 issued Mar. 28, 1967 to R. R. Bernard et al; U.S. Pat. No. 3,407,701 issued Oct. 29, 1968 to R. E. Chiabrandy; and U.S. Pat. No. 3,568,563 issued Mar. 9, 1971 to L. R. Folsom. In these conventional Gatling guns, the bolts are driven by a substantially helically shaped cam cut into the housing. Rotation of the rotor, in which the bolts are guided for reciprocation in longitudinal tracks, forces the bolt drive rollers against the cam to drive the bolts forward and back in ram and extraction strokes respectively. The slope of this cam limits the degree to which the housing diameter can be decreased. As the housing is made smaller in diameter, the cam steepens (i.e. approaches the perpendicular to the longitudinal axis until the driving angle becomes too steep and jams the bolt drive roller. In U.S. Pat. No. 3,834,272 issued Sept. 10, 1974 to R. A. Patenaude et al, an external power source separately drives the rotor and an actuator for the gun bolts.

SUMMARY OF THE INVENTION

An object of this invention is to provide a direct drive by the power source of each of the gun bolts of a Gatling gun.

Another object of this invention is to provide a Gatling gun wherein the power source drives the gun bolts, which bolts in turn, drive the rotor.

Yet another object is to provide a Gatling gun whose housing has a maximum diameter which is less than that possible in Gatling guns wherein a helical cam drives the gun bolts.

A feature of this invention is a Gatling gun wherein a fluid under pressure drives a plurality of double acting pistons to respectively reciprocate each of the gun bolts in the rotor. The gun bolts have respective cam followers which operate in a stationary helical cam to cause rotation of the rotor.

BRIEF DESCRIPTION OF THE INVENTION

These and other objects, features and advantages of the invention will be apparent from the following specification thereof taken in conjunction with the accompanying drawing in which.

DESCRIPTION OF THE INVENTION

Figure 1:
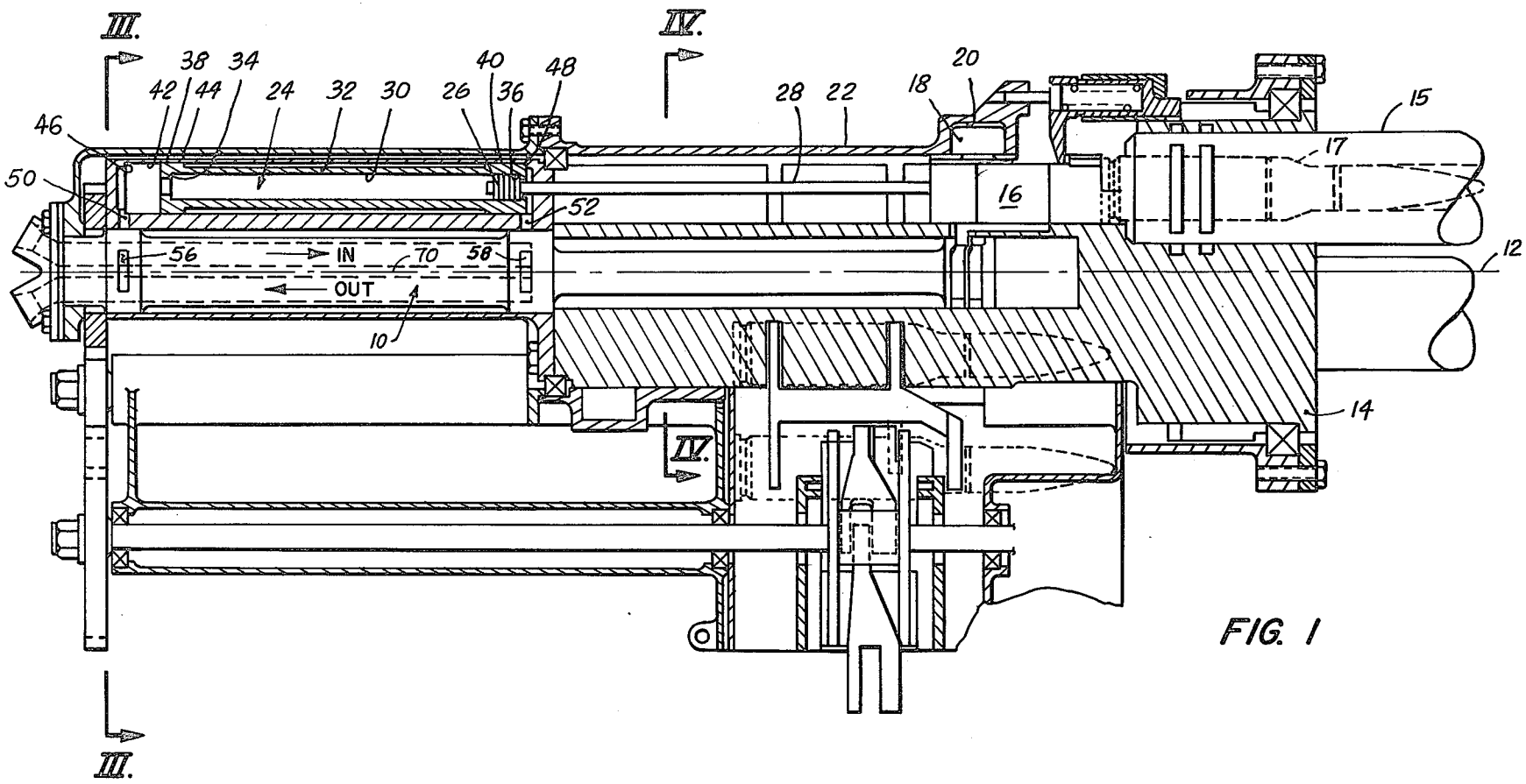
FIG. 1 is a side view in cross-section of a portion of a Gatling gun embodying this invention.

The invention may be incorporated in a conventional type Gatling gun or in the Gatling gun shown in U.S. Pat. No. 3,834,272, supra.

A fluid manifold 10 is stationary and disposed on the longitudinal axis 12 of the gun. The barrel cluster or rotor 14 is journaled for rotation about the manifold 10 and the axis 12. The cluster has a plurality of gun barrels 15, e.g. three, each having a respective gun bolt 16 for carrying a round of ammunition 17, and which bolt is journaled for reciprocation along the axis of the respective gun barrel. Each bolt 16 has a respective cam roller 18, and which roller rides in a cam track 20 in a stationary housing 22.

The barrel cluster also has a like plurality, e.g. three, of piston assemblies 24, which rotate about the manifold 10. Each piston assembly includes a piston head 26 which is fixed to the bolt 16 by a rod 28. The piston head 26 reciprocates within a longitudinal bore 30 in a sleeve 32. The bore 30 is bounded by an aft shoulder stop 34 and a stop 36. The sleeve 32 has an aft piston head 38 and a forward piston head 40, and reciprocates within a longitudinal bore 42 in a housing 44 which is part of the rotating barrel cluster. The bore 42 is bounded by an aft shoulder stop 46 and a forward shoulder stop 48. Each housing has an aft radial port 50 providing access aft of the piston heads 38 and 26, and a forward radial port 52 providing access forward of the piston heads 40 and 26.

The fluid manifold 10 includes a fluid inlet duct 54 having an aft outlet 56 to the piston port 50 and a forward outlet 64 to the piston port 52; and a fluid outlet duct 60 having an aft inlet 62 from the piston port 50 and a forward inlet 58 from piston port 52.

As shown in FIG. 1, when both piston heads 38 and 26 are aft, initially at rest, a relatively large area consisting substantially of the annular transverse surface of the head 38 and the circular transverse surface of the head 26 is presented to the flow of fluid which, via the duct 54 and the port 56, enters the aft part of the housing 44 through the port 50. This provides a relatively large force coupled to the piston rod 28 and a relatively high initial forward acceleration of the bolt as both the piston head 26 and the sleeve 32 slide forward together. The head 26 is loaded by the bolt, and pushed by the head 38. However, when the sleeve 32 reaches the forward limit of its stroke, as defined by the stop 48, a relatively small area, consisting substantially of the circular transverse surface of the head 26 alone, is presented to the flow of fluid, and a relatively lower force is coupled to piston rod 28 as the piston head travels forwardly alone to the forward limit of its stroke, as defined by the stop 36. Since the head 26 alone sweeps out a volume of smaller diameter than the sleeve, it requires a smaller volume of fluid to undergo this part of the stroke. During the forward stroke, fluid in the housing forward of the piston heads 40 and 26 is discharged through the ports 52 and 58 into the discharge duct 60.

When both piston heads 40 and 26 are forward, initially at rest, a relatively large area consisting substantially of the annular transverse surface of the head 40 and the annular transverse surface of the head 26, less the transverse cross-section of the rod 28, is presented to the flow of fluid which, via the duct 54 and the port 64, enters the forward part of the housing 44 through the port 52. This provides a relatively large force coupled to the piston rod 28 and a relatively high initial aftward acceleration of the bolt as both the piston head 26 and the sleeve 32 slide aftward together. However, when the sleeve 32 reaches the aft limit of its stroke, as defined by the stop 46, a relatively small area consisting substantially of the annular transverse surface of the head 26 less the cross-section of the rod is presented to the flow of fluid, and a relatively lower force is coupled to the piston rod as the piston head travels aftwardly alone to the aft limit of its stroke, as defined by the stop 34. During the aftward stroke, fluid in the housing aft of the piston heads 38 and 26 is discharged through the ports 50 and 62 into the discharge duct 60.

Figure 6:
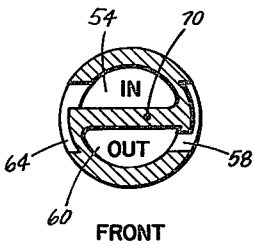
FIG. 6 is a detail aft view in cross-section of the forward ports of the fluid manifold of the gun of FIG. 1.
Figure 5:
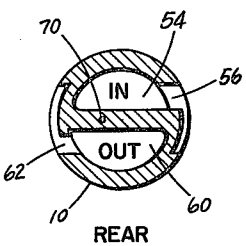
FIG. 5 is a detail aft view in cross-section of the rear ports of the fluid manifold of the gun of FIG. 1.
Figure 8:
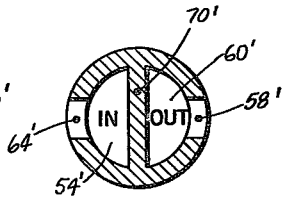
FIG. 8 is a detail aft view in cross-section of the forward ports of the alternative fluid manifold of FIG. 7.
Figure 7:
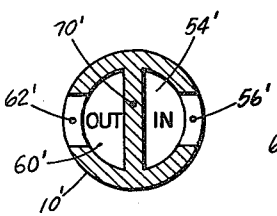
FIG. 7 is a detail aft view in cross-section of the rear ports of an alternative fluid manifold for the gun of FIG. 1.
Figure 2:
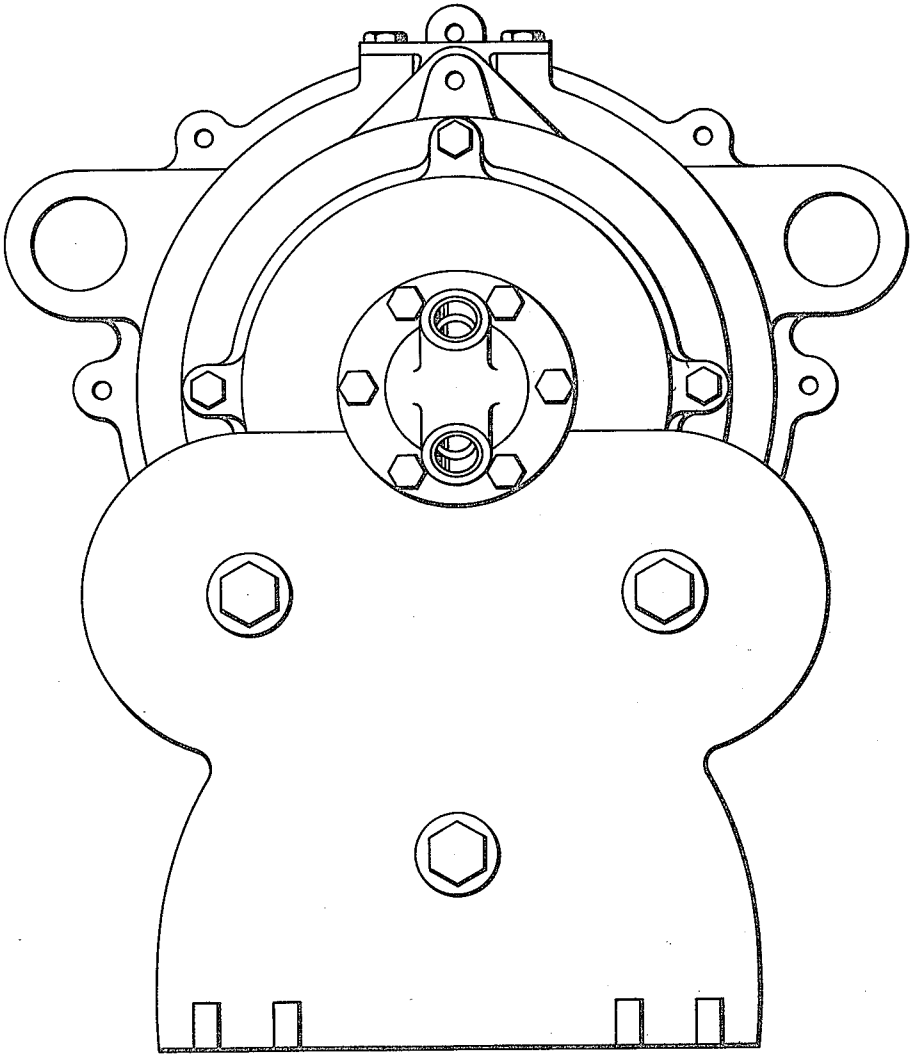
FIG. 2 is an aft view of the gun of FIG. 1.
Figure 4:
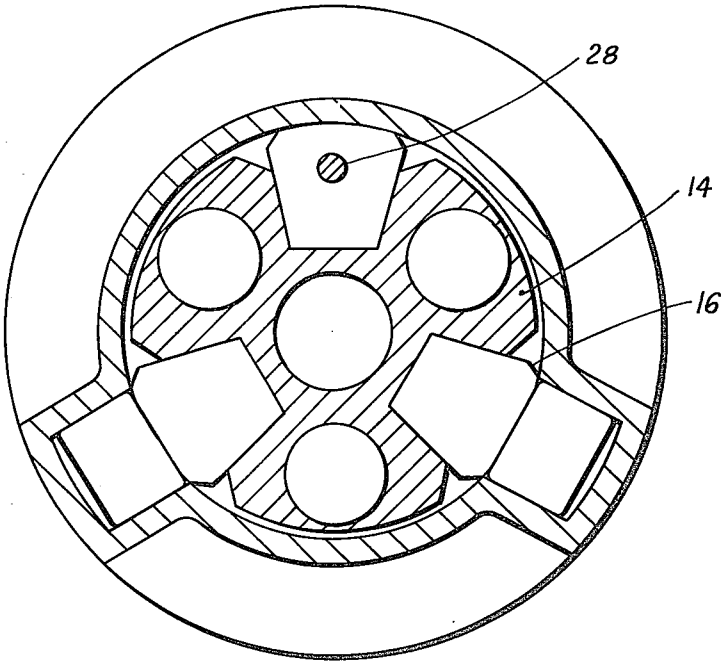
FIG. 4 is an aft view in cross-section taken along plane IV—IV of FIG. 1.
Figure 3:
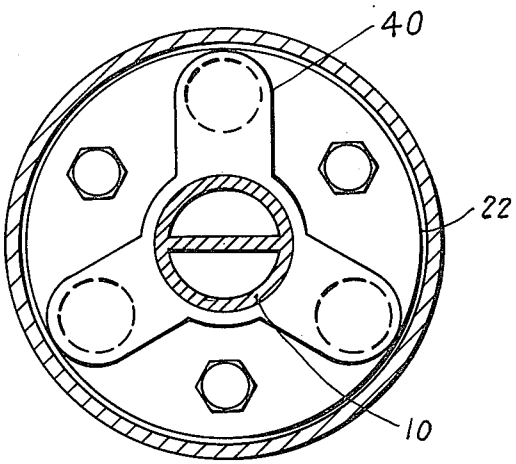
FIG. 3 is an aft view in cross-section taken along plane III—III of FIG. 1.

The manifold 10 shown in FIG. 5 and 6 has a septum 70 which is a flat plane along its full length. The manifold 10' shown in FIGS. 7 and 8 has a septum 70[1] which has a 180° transverse twist along its length between the aft and forward ports.

The fluid which is supplied to the manifold 10 may be either hydraulic or gas. If hydraulic, it may be provided from a pressurized reservoir by means of a suitable solenoid operated valve. If gun gas, the barrel cluster may be initially accelerated by an external source of rotational force in conjunction with gas developed by firing rounds of ammunition provided to the manifold, or the gun gas alone through the manifold may be utilized to accelerate and maintain the speed of the barrel cluster.

In a Gatling gun mechanism, relatively high forces are required to initially accelerate the bolts at the start of their respective forward and aftward strokes. Once each bolt is moving, the force can be substantially less. This, conventionally, would require a relatively large piston area against which the fluid initially can act. However, a simple large piston in a cylinder would continue to sweep out its area, even when high force is no longer required. An excess volume of fluid would be required merely to fill up the cylinder volume. The herein disclosed variable volume cylinder provides a reduced demand for fluid when maximum force is no longer required. The improvement shown herein provides a variable area piston arrangement which presents a large area at beginning of each of its to and fro strokes, when large forces are desired, but which sweeps out a smaller area in the remaining portion of such strokes, when less fluid is required. A reduction in the fluid volume flow requirement results.

The invention provides the following advantages, among others:

The actuating forces for the bolts are applied directly to the bolts, respectively and coaxially.

The bolt rollers cause the rotation of the barrel cluster. The cam angles can be steep in the conventional sense, permitting the housing and the rotor to be of relatively small diameter.

Porting of the drive fluid is controlled by the rotational position of the barrel cluster.

The actuating forces for the bolt are largest at the beginning of the ram and the extract strokes, when acceleration of the bolts is required. The actuating forces, and the fluid flow, are reduced for the sustaining portion of such strokes of the bolt.

The driving fluid may be either gas or liquid. Gas may be either externally supplied, as from a reservoir, or tapped from the firing barrels.

What is claimed is:

1. A gun comprising:

a stationary housing;

a stationary fluid manifold having a first inlet port, first outlet port, a second inlet port and a second outlet port;

a rotor journaled for rotation with respect to said manifold, and having:

a plurality of gun barrels, a like plurality of gun bolts, a like plurality of cylinders, each having a double-acting piston therein, each of said pistons coupled to a respective one of said bolts for reciprocating said bolt through a ram stroke and an extract stroke with respect to a respective one of said barrels, each of said cylinders having:

a respective first port for cooperation with said first inlet port and said first outlet port of said manifold, and a second port for cooperation with said second inlet port and said second outlet port of said manifold, whereby in response to the rotational orientation of said rotor with resepct to said manifold, each of said cylinders in sequence, during one time interval has its first port coupled to said manifold first inlet port and its second port coupled to said manifold second outlet port, and during another time interval has its first port coupled to said manifold first outlet port and its second port coupled to said manifold second inlet port.

2. A gun according to claim 1 wherein:

said stationary housing has a first drive means;

each of said bolts has a second drive means which is disposed for cooperation with said first drive means and which is journaled for reciprocation in said rotor;

whereby reciprocation of said bolts drives said second drive means with respect to said first drive means to rotate said rotor with respect to said housing.

3. A gun according to claim 2 wherein:

said first drive means is a helical cam track; and each of said second drive means is a cam.

4. A gun according to claim 3 wherein:

said cam is a roller journaled for rotation about an axis which is perpendicular to the axis of reciprocation of said respective gun bolt.

5. A gun according to claim 1 wherein:

each of said pistons has a variable area structure which presents a first, relatively large area, at the beginning of each of its strokes, and a second, relatively smaller area, during the respective remainder of such strokes.

6. A gun according to claim 1 wherein:

a supply of fluid under pressure is coupled to said fluid manifold for provision to said inlet ports of said manifold.

7. A gun according to claim 6 wherein:

each of said pistons has a variable area structure which presents a first relatively large area to the flow of fluid in its respective cylinder at the beginning of each of its ram and extract strokes, and a second, relatively smaller area, during the respective remainder of such strokes.

8. A gun according to claim 7 wherein:

each of said variable area structures of said pistons includes a main piston having a stroke full length, and a sleeve having a stroke of less than full length.

* * * * *